United States Patent [19]

Swider et al.

[11] 4,156,040

[45] May 22, 1979

[54] COAGULATION COATING PROCESS

[75] Inventors: Robert A. Swider, Livonia; Gordon G. Strosberg, Southfield, both of Mich.

[73] Assignee: Ford Motor Company, Dearborn, Mich.

[21] Appl. No.: 865,044

[22] Filed: Dec. 27, 1977

Related U.S. Application Data

[63] Continuation of Ser. No. 685,809, Feb. 17, 1976, abandoned.

[51] Int. Cl.[2] ..... B05D 3/02

[52] U.S. Cl. ..... 427/226; 427/302; 427/376 A; 427/376 H; 427/379; 427/383 D; 427/430 R; 427/436

[58] Field of Search ..... 427/302, 340, 376 A, 427/376 H, 379, 383 D, 430 R, 436, 226

[56] References Cited

U.S. PATENT DOCUMENTS

| | | | |
|---|---|---|---|
| 3,218,191 | 11/1965 | Domanski | 427/302 |
| 3,930,074 | 12/1975 | Drelich et al. | 427/302 |

*Primary Examiner*—Bernard D. Pianalto

*Attorney, Agent, or Firm*—Roger L. May; Keith L. Zerschling

[57] ABSTRACT

A coagulation process for coating various substrates with organic resins which may be admixed with reactive or nonreactive particles. The process comprises (A) providing the substrate to be coated with a dry coagulating compound surface and (B) exposing said substrate to an aqueous bath comprising an organic film forming material, at least fifty (50) weight percent of which is a chemically ionizable organic film-former which (i) has at least 12 carbon atoms per molecule; (ii) is at least partially ionized such that it is substantially soluble in said aqueous bath; and (iii) coagulates in the presence of said coagulating compound.

36 Claims, No Drawings

COAGULATION COATING PROCESS

This is a continuation of application Ser. No. 685,809, filed Feb. 17, 1976 and now abandoned.

The invention disclosed and claimed herein relates to a coagulation coating process which is useful for applying coatings to various substrates.

More particularly, the process relates to the deposition of organic resins, which may be admixed with reactive or nonreactive particles, by coagulation on the surface of various substrates, followed by curing, aging or other treatments to provide the desired properties for the coating. The process may be employed to provide numerous types of coatings on many different substrates or articles. For example, coatings may be applied to: (1) improve corrosion and oxidation resistance at ambient and elevated temperatures of metal substrates such as turbine engine components, automotive exhaust train components, and automotive interior and exterior components; (2) reduce or eliminate water and/or solvent permeability of porous materials such as wood, unglazed ceramics, paper and fabrics; (3) improve solvent resistance of organic surfaces; (4) enhance the decorative value of metallic and nonmetallic surfaces such as on the interior and exterior of automobiles; (5) provide electrical insulation on conductive surfaces; (6) provide conductive surfaces on nonconductive substrates; (7) provide lubricants on metallic and nonmetallic surfaces such as graphite lubricant coatings for forged articles; and (8) provide acid and alkali resistant glass coatings for items such as water heaters.

BACKGROUND OF THE INVENTION

Methods for coating surfaces by coagulation from both acid and alkaline aqueous dispersions of polymeric particles are known in the art. Representative methods of coagulation coating from an acidic aqueous solution are discussed in U.S. Pat. Nos. 3,709,743 and 3,791,431. U.S. Pat. No. 3,791,431 discusses a method wherein an organic coating is applied to a metallic surface by immersing the surface in an acidic aqueous coating composition containing particles of an organic coating-forming material. The organic material may be in either dissolved, emulsified, or dispersed form. The coating composition is acidic as a result of the inclusion of an acidic oxidizing agent such as a mineral acid. This acidic oxidizing agent attacks the metal substrate causing metal ions to be dissolved from the surface. These ions cause the coating-forming material to be unstable in the region of the surface and, as a result, it deposits on the surface. One of the problems with this type of process is that the coating composition tends to become unstable as metal ions build up with repeated use. U.S. Pat. No. 3,791,431 seeks to remedy this problem by removing metal ions from the composition or adding a material to render the metal ions innocuous. The necessity of this additional step, of course, complicates the process and adds a further parameter which must be monitored and controlled during processing.

The process of U.S. Pat. No. 3,709,743, which is similar to the above-discussed process also employs an oxidizing acid which attacks a metallic substrate causing metal ions to form which, in turn, cause coagulation of an organic coating. Thus, this suffers the same disadvantages with respect to metalic ion build-up. The process of 3,709,743 also employs an aqueous bath containing an anionic surfactant stabilized emulsion of the synthetic resinous film-forming composition and, as a result, suffers from certain other serious deficiencies which are treated more thoroughly in the discussion of prior art alkaline bath coagulation methods set forth below. Of course, it will also be noted that both of the acidic bath embodiments disclosed in the above referenced patents are useful only to coat certain metallic substrates. It should also be noted that both of these prior art processes also are unsuitable for the application of aluminide coatings because of the presence of strong oxidizing acids.

Many prior art references disclose applying coatings such as natural latex or synthetic latices by coagulation from alkaline aqueous dispersions of essentially insoluble particles. U.S. Pat. Nos. 3,411,982 and 3,856,561 teach processes which are representative of these alkaline bath processes. These processes involve deposition of synthetic latices, which may contain small amounts of acrylic or methacrylic acid and which can be used alone or in combination with styrene, polystyrene, polyethylene chloride, polyvinyl chloride, polyvinyledene chloride and polyacrylate resins, and vinyl chloride butyl acrylate copolymers,, by polyvalent destablization of stabilized polymers. In that process the polymers are anionically stabilized or stabilized with anionic surfactants in combination with nonionic surfactants or reaction products of such. Soluble alkalies such as potassium hydroxide or ammonium hydroxide are also added in some cases to control pH and/or to assist the stabilizer in producing emulsions of the particles in water.

The presence of such anionic and nonionic surfactants or mixtures of nonionic and anionic surfactants or reaction products of such can have a deleterious effect on the final properties of coagulated polymer coatings by building up in the bath and/or in the coagulated film. Another disadvantage of such processes is the tendency of the emulsions to be unstable in the presence of chemically reactive substances such as pigments that release ions into solution and cause coagulation of dispersed film former. Still another disadvantage of such processes is that the dispersed latices have a tendency to swell in the presence of various solvents.

BRIEF DESCRIPTION OF THE INVENTION

The improved process of this invention, which overcomes the deficiencies of prior art techniques, involves the controlled coagulation of water soluble polymers along with, if desired, pigments which may be either inert or chemically reactive. The coagulation or desolubilization of the chemically soluble or solubilized polymer is effected as a result of contact of the polymer with a coagulating compound which is applied to the substrate to be coated prior to exposure of the substrate in the aqueous bath containing the polymer.

The improved process has many advantages including:

1. A high degree of bath stability;
2. Uniformity and homogeneity of coagulated film;
3. Elimination of the use of anionic or nonionic stabilizers or reaction products thereof and/or mixtures of such stabilizers to provide dispersions of polymers in water;
4. Improved film thickness control;
5. Minimization of polymer swelling, thus avoiding coagulation through dehydration;
6. Minimization of coagulation by reactive pigments such as finely divided powders of aluminum, catalytic platinum, lead pigment extenders alkali earth silicates and borates, etc.;

7. Improved corrosion protection for metallic surfaces especially when the polymers are: (a) coagulated as a mixture of corrosion inhibiting pigments and pigment extenders where the resin comprises the bulk of said mixture (commonly referred to as paints); (b) coagulated onto metal surfaces as a mixture of a minor amount of polymer and a major amount of metal pigments and heat treated at a temperature below the melting point of the metal particles in an atmosphere essentially inert to said particles to vaporize or thermally degrade the polymer so that metal particles may then be heated so as to react with and modify the metal substrate; (c) coagulated as a mixture of a minor amount of polymer and a major amount of refractory or ceramic enamel frit, and heat treated in an oxidizing atmosphere at temperatures above the point where the polymer vaporizes or thermally degrades so that the frit particles may then be fused with said metal substrate to form an adherent acid, alkali, high temperature or electrically resistant coating depending upon characteristics of the frit;

8. Improved water impermeability of porous surfaces such as wood (laminated or unlaminated) by coagulation of a coating consisting of a mixture of a major amount of polymer and a minor amount of pigments so that when such coatings are heated below the thermal flash point of the coated article and essentially at the cure temperature of the coagulated coating, an adherent water resistant coating is formed; and 9. Limits the use of toxic and/or corrosive oxidizing and reducing mineral acids such as hydrochloric, sulfuric, nitric, chromic, hydrofluoric, hydrobromic, oxychloroacetic, chloroacetic acid, etc., and low molecular weight organic acids, as coagulants.

These and other advantages will be more readily apparent after reading the following detailed description of the invention.

DETAILED DESCRIPTION OF THE INVENTION

The process claimed in this application relates to a coating process which comprises (A) providing the substrate to be coated with a dry coagulating compound surface; and (B) exposing said substrate to an aquaous bath comprising an organic film forming material, at least fifty (50) weight percent of which is a chemically ionizable organic film former which (i) has at least 12 carbon atoms per molecule; (ii) is at least partially ionized such that it is substantially soluble in said aqueous bath; and (iii) coagulates and deposits in the presence of said coagulating compound.

In one preferred embodiment of the process the coagulating compound employed has a pH of less than 7.0 and the organic film former is a synthetic polycarboxylic acid resin which (i) is at least partially neutralized with a water soluble base, (ii) advantageously has an electrical equivalent weight between about 1,000 and about 20,000, and (iii) advantageously has an acid number between about 30 and about 300.

In a second preferred embodiment of the process, the coagulating compound employed has a pH greater than 7.0 and the organic film-former is selected from basic monomers and resins having one or more nitrogens in their molecular structure and is at least partially neutralized by a water soluble acid compound (including a compound which can produce an acid compound when reacted with a basic resin).

Coagulating Compounds

In accordance with the process of the invention, the substrate to be coated is first provided with a dry coagulating compound surface. This can be accomplished in a number of ways which will be apparent to those skilled in the art. For example, the compound or mixture of compounds may be dissolved in suitable volatile solvents or mixtures of such suitable solvents (e.g. water, alcohols, acetones, cellosolves, etc.) and the solution then applied to the substrate by known means such as dipping, roll coating, spraying, etc. The coated substrate is then dried to remove the volatile solvent(s), thus leaving a surface coating of dry coagulating compound. If desired, the compound solution may include soluble or partially insoluble conditioning agents such as cellulose, cellulose acetates, colloidal silicates, polyvinylpyrolidones, etc. to promote uniform application of the compound on the substrate. Generally, the coagulating compound will comprise between about 1 and about 40 weight percent of such solution. The coagulating compound surface may also be provided, for example, by application of the compound or mixture of compounds in dry form in combination with conditioning agents, if required, such as finely divided aluminum oxide, silica, mica, glass, etc. to promote the uniform application of the compound(s) on the surface by any known prior art techniques such as dry dipping, blasting, surface grinding, fluidized bed, etc. By way of a still further example, the coagulating compound may be formed on the substrate surface by application of a material to the substrate which reacts with or otherwise modifies the substrate surface to form a coagulating compound surface.

As mentioned above when the organic film-former is a synthetic polycarboxylic acid resin, the coagulating compund must have a pH less than 7.0. The preferred coagulating compound for use in this embodiment of the process is a salt. Preferred salts are salts of polyvalent metals. The salts of bivalent metals such as magnesium, the alkaline earths, zinc, copper, cobalt, cadmium, ferrous iron, lead, nickel and manganese are preferred, but the salts of polyvalent metals such as aluminum, ferric iron, antimony, chromium, molybdenum, tin, thorium and zirconium may also be used. In general, the chlorides and nitrates of these metals are the most useful because of their availability and great solubility in water and organic solvents, but the bromides iodides, fluorides, chlorates, bromates, perchlorates, sulfates, persulfates, thiosulphates, permanganates, chromates, hypophosphites, thiocyanates, nitrites, acetates, formates, oxalates, etc. of some of the meals are sufficiently soluble to merit consideration. Of all the salts mentioned, the salts of metals of the First Transition Series are preferred, with nickel being most preferable. The salts are also preferably salts of strong acids, i.e., pH less than 4.5, and most preferably exhibit a pH in the range of 3.5 to 4.5. A list of salts which are ideal for use in this embodiment and their pH (10% by weight Aqueous) is as follows:

| Formula | pH (10% by Weight Aqueous) |
|---|---|
| $NiCl_2 . 6H_2O$ (Nickel Chloride) | 4.0 |
| $CuCl_2 . 2H_2O$ (Cupric Chloride) | 3.6 |
| $CoCl_2 . 6H_2O$ (Cobaltous Chloride) | 4.5 |

-continued

| Formula | pH (10% by Weight Aqueous) |
|---|---|
| $CuNO_3 . 6H_2O$ (Cupric Nitrate) | 4.0 |
| $NiNO_3 . 6H_2O$ (Nickel Nitrate) | 4.0 |
| $CuSO_4 . 5H_2O$ (Cupric Sulfate) | 4.0 |
| $ZnCl_2 . 6H_2O$ (Zinc Chloride) | 4.0 |

In this embodiment of the process another preferred manner of forming the metal salt when the substrate is metal is to apply an acid which will react with the metal to form a metal salt. Such acids may include acids such as formic, acetic, oxalic, hydrochloric and sulphuric and preferably are strong mineral acids.

In the course of the coagulation process of the embodiment, the dry metal salt hydrate, when wetted, forms ions at the salt layer interface, which ions react with the polycarboxylic acid moiety of the acid resin. It is thought that the metal ions are free to react with the resin to form complex organometallic compounds which, in turn, coagulate to form a film of resin on the continuously reacting salt (see "Electrodeposition of Epoxy Resin on Electrodes of Iron and Platinum", *Journal of Paint Technology*, Vol. 12, No. 515, June, 1970). As suggested in the above reference, coagulation by formation of metallic complexes may occur as follows:

$$M^o — M^{n+} + ne^-$$

$$n(RCOO^-) + M^{n+} — M\,(RCOO)_n$$

A secondary reaction which may take place at the salt bath interface and which is possibly coupled with the first reaction is the precipitation of the acid resin in an acid form as follows:

$$RCOO^- + H^+ — RCOOH$$

Complexing through chelation and formation of other complex coordination compounds may play an important role in the first reaction.

The reactions set forth above are merely suggestions with respect to the possible mechanism of coagulation and should not be considered limitations on the process of the invention.

As also mentioned above, when the organic film-former is selected from basic monomers and resins having one or more nitrogens in their molecular structure, the compound must have a pH greater than 7.0. Preferred coagulating compounds for use in this embodiment include: any or all of the soluble alkali earth metal salts such as sodium, potassium and lithium salts and/or other salts of strong bases and weak acids and/or mixtures of said salts which exhibit a pH in solution greater than 7.0 and preferably greater than 10.0. Exemplary of the many salts which fall within this category and which will be apparent to those skilled in the art are: carbonates, silicates, oxalates, salicylates and formates of alkali earth metals sodium, potassium and lithium.

A second preferred type of coagulating compound for use in this embodiment of the process includes strong bases, i.e., those with a pH greater than 10.0, such as the alkali earth metal hydroxides.

Film-Former

All embodiments of the invention employ an organic film-forming material, at least fifty (50) weight percent of which is a chemically ionizable, organic film-former which (i) has at least 12 carbon atoms per molecule; (ii) is at least partially ionized such that it is substantially soluble in said aqueous bath, i.e., sufficiently soluble that the film-former molecule would behave in the manner of an anionic (or cationic as the case may be) polyelectrolyte under the influence of a direct electric current when such aqueous bath is employed as the bath of an electrodeposition cell (in contrast to the behavior in the manner of a hydrophilic colloid, e.g., an inert resin globule encased in a soap film and emulsified); and (iii) coagulates in the presence of said coagulating compound.

The organic film-former used in the process of this invention, unlike the film-formers used in processes discussed previously wherein ionic or nonionic stabilizers and/or reaction products of such are used, is a coating salt which is substantially soluble in water. In the prior art processes referred to the anionic or nonionic stabilizers and/or reaction products thereof are required to form emulsions of discretely insoluble particles in water. Essentially, the stability of such conventional emulsions used for the coagulation of a coating on a surface is provided by (1) anionic (e.g. alkyl-aryl sulfonates) or soap-like stabilizers which form a protective film around essentially insoluble particles keeping them from coalescing. The same pertains to nonionic stabilizers, except these materials (e.g. reaction product of ethylene oxide and oleyl alcohol or octyl phenoxy polyethoxyethanol) are used most commonly in combination with one or more anionic stabilizers which are salts or alkali metal salts of organic acids, particularly sulfates, phosphates or carboxylates.

In the coagulation mechanism of such conventional methods, the coagulating ion acts on the stabilizers, destroying the protective film around the particles and causing them to coalesce. It is the stabilizer which is antagonized in such a process. In the process of this invention, on the other hand, it is the solubilized polymer which is antagonized.

In the first embodiment of the process, discussed above, the coagulating compound has a pH of less than 7.0 and the organic film-former is a synthetic polycarboxylic acid resin which (i) is at least partially neutralized with a water-soluble base, (ii) advantageously has an electrical equivalent weight between about 1,000 and about 20,000, and (iii) has an acid number between above 30 and about 300.

The electrical equivalent weight of a given resin or resin mixture is herein defined as that amount of resin or resin mixture that will deposit per Faraday of electrical energy input under the conditions of operation set forth in detail below. For this purpose, the value of one Faraday in coulombs is herein taken to be 107.88 (atomic weight of silver) $\div$ 0.001118 (grams of silver deposited by one coulomb from silver nitrate solution) or 96.493. Thus, if 0.015 gram of coating, the binder polycarboxylic acid resin moiety of which is 90% by weight and the balance of which is amino compound used to disperse it in the bath is transferred and coated on the anode per coulomb input to the process, the electrical equivalent weight of the resin is about 1303 or $0.015 \times 0.9 \times 107.88 \div 0.001118$. By way of further illustration we find electrical equivalent weight (in the nature of a gram equivalent weight in accordance with Faraday's laws) of a particular polycarboxylic acid resin or resin mixture simply and conveniently for typical process conditions standardized on as follows: a polycarboxylic acid resin concentrate is made up at 65.56° C. (150° F.) by thoroughly mixing 50 grams of polycarboxylic acid resin, 8 grams of distilled water and diisopropanol amine in an amount sufficient to yield resin dispersion pH of 9.0 or slightly lower after the concentrate has been reduced to 5% by weight resin concentration with additional distilled water. The concentrate is then diluted to one liter with additional distilled water to give 5% resin concentration in the resulting dispersion. (If a slight insufficiency of the amine has been used, and the dispersion pH is below 9.0, pH is brought up to 9.0 with additional diisopropanol amine.) The dispersion is poured into a metal tank, the broadest side walls of which are substantially parallel with and 2.54 cm. out from the surfaces of a thin metal panel anode. The tank is wired as a direct current cathode, and the direct current anode is a 20 gauge, 10.17 cm. (4 inches) wide, tared steel panel immersed in the bath 7.62 cm. (3.5 inches) deep. At 26.67° C. (80° F.) bath temperature and while the bath is agitated sufficiently to provide turbulent flow direct current is impressed from anode to cathode at 100 volts for for one minute from an external power source, the current measured by use of a coulometer, and the current turned off. The anode panel is removed immediately, rinsed with distilled water, baked for 20 minutes at 176.67° C. (350° F.) and weighed. All volatile material such as water and amine is presumed to be removed from the film for practical purposes by the baking operation. The difference between tared weight of the fresh panel and final weight of the baked panel divided by the coulombs of current used, times 107.88, divided by 0.001118 gives the electrical equivalent weight of the resin for purposes of this invention.

The polycarboxylic acid resins useful in the process include any of the polycarboxylic acid resins useful in the electrodeposition of paint from an aqueous bath. These acidic film-forming materials include, but not by way of limitation coupled oils such as sunflower, safflower, perilla, hempseed, walnut seed, dehydrated castor oil, rapeseed, tomato seed, menhaden, corn, tung, soya, oiticia, or the like, the olefinic double bonds in the oil being conjugated or nonconjugated or a mixture, the coupling agent being an acyclic olefinic acid or anhydride, preferably maleic anhydride, but also crotonic acid, citraconic acid or anhydride, fumaric acid, or an acyclic olefinic aldehyde or ester of an acyclic olefinic ester such as acrolein, vinyl acetate, methyl maleate, etc., or even a polybasic acid such as phthalic or succinic, particularly coupled glyccride oils that are further reacted with about 2 to about 25% of a polymerizable vinyl monomer; maleinized unsaturated fatty acids; maleinized resin acids, alkyd resins, e.g., the esterification products of a polyol with polybasic acid, particularly glyceride drying oil-extended alkyd resins; acidic hydrocarbon drying oil polymers such as those made from maleinized copolymers of butadiene and diisobutylene; diphenolic acid and the like polymer resins; and acrylic vinyl polymers and copolymers having carboxylic acid groups such as butyl acrylate-methyl methacrylate-methacrylic acid copolymers, acrylic acid and lower alkyl ($C_1$ to $C_4$) substituted acrylic acid-containing polymers, i.e., those having carboxyl groups contributed by alpha-beta unsaturated carboxylic acids or residues of these acids, etc.

These and other suitable resins are described in detail in many patents of which U.S. Pat. Nos. 3,230,162; 3,335,103; 3,378,477 and 3,403,088 are illustrative.

As discussed in the cited patents the polycarboxylic acid resin can also be modified and extended in various ways without impairing its useful characteristics. Thus, one may use polycarboxylic acid resins wherein there is blended thermoplastic, non-heat reactive phenolic resins into the polycarboxylic acid resin batches, which extended resins then were dispersed in water with the polyfunctional amino compound. The heating together, preferably with agitation, of the polycarboxylic acid resin with such phenolic resin for at least about ½ hour, and preferably about one to two hours or more, at a temperature between about 200° and about 260° C. appears to give a chemical bonding between those two components and no free phenolic resin mixture. Thus, when the resulting resin is used in the process, the coating is essentially homogenous, and in a bath containing the resulting resin product there is no appreciable accumulation of free phenolic bodies dissociated from the resin in an appreciable operating time.

Other suitable extenders for the polycarboxylic acid resins include hydrocarbon resins such as cumarone-indene resins, which are generally inert and thermoplastic, and diolefinic petroleum resins such as those or essentially naphthenic structure which are heat-reactive, e.g., cyclopentadiene resins. Addition of resins such as this also can give increased chemical resistance to the resulting cured film. Many other resinous extenders and film plasticizers of conventional nature, e.g., amino aldehyde resins, butadiene-styrene latices, vinyl chloride and vinylidene chloride homopolymer and copolymer latices, polyethylene resins, fluorocarbon resins, bis phenolglycidyl ether resins, dicyclo diepoxy carboxylate resins, etc., are permissible also, provided, however, that their concentration is not so high as to mask the characteristics of the polycarboxylic acid resin.

Another acidic material which may be employed is an organic acid containing at least about 12 carbon atoms, e.g., lauric acid (dodecanoic acid), stearic acid (octodecanoic acid), etc. These are preferably used in conjunction with a minor amount of neutral or essentially neutral film-forming polymers, e.g., polyesters, hydrocarbon resins, polyacrylates, polymethacrylates, etc., but may be used alone or with the aforementioned carboxylic acid resins.

As mentioned above, the carboxylic acid is at least partially neutralized in the coagulation bath with a suitable water soluble base. The preferred water soluble bases are alkaline earth metal hydroxides with sodium hydroxide being most preferred. Other water soluble bases which may be effectively used include water soluble bases which may be effectively used include water soluble amino compounds and ammonia.

The especially suitable water soluble amino compounds are soluble in water at 20° C. to the extent of at least about 1% basis weight of solution and include hydroxy amines, polyamines and di- and polyfunctional monomericamines such as: monoethanolamine, diethanolamine, triethanolamine, N-methyl ethanolamine, N-aminoethylethanolamine, N-methyldiethanolamine, monoisopropanolamine, diiopropanolamine, triisopropanolamine, "Polyglycol amines" such as $HO(C_2H_4O)_2C_3H_6NH_2$, hydroxylamine, butanolamine, hexanolamine, methyldiethanolamine, octanolamine, and alkylene oxide reaction products of mono- and polyamines such as the reaction product of ethylene diamine with ethylene oxide or propylene oxide, laurylamine with ethylene oxide, etc.; ethylene diamine, diethylene triamine, triethylene tetramine, hexamethylene tetramine, tetraethylene pentamine, propylene diamine 1,3 diaminopropane, imino-bis-propyl amine, and the like; and mono-di-and tri-lower alkyl ($C_{1-8}$) amines such as mono-, di- and triethyl amine.

When using amines we have found that the best films are deposited when about 30–60% total amino equivalents present in the bath, both combined and free, are contributed by water soluble polyamine, and thus I prefer to operate that way when using amines. Preferably, when using amines diethylene triamine is employed for efficiency and economy. The polyamine can be added to the bath along with supplemental binder concentrate composition dosing or separately.

The hydroxy amines, particularly those that are aliphatic in nature at points of hydroxyl attachment, such as the alkanol amines are also very useful for treating the polycarboxylic acid resin for dispersion and appear to have some desirable resin solubilizing effect in water over and above their neutralizing action.

In the second above mentioned embodiment, the coagulating compound has a pH greater than 7.0 and the organic film-former is selected from basic monomers and resins having one or more nitrogens in their molecular structure. This basic material contains at least 12 carbon atoms, e.g., lauryl amine, stearyl amine, etc. Obviously, when the basic material is polymeric, it will be of substantially greater molecular weight.

Examples of the basic resins containing nitrogen atoms in the molecule are amino group-added epoxy resins (aminoepoxy resins), amino group-containing acrylates (aminoacryl resins), amino group-containing vinyl compound copolymers (aminovinyl resins) and polyamide resins.

The aminoepoxy resins may be obtained by adding any organic amino compound to an epoxy group in an epoxy resin or epoxy modified resin. A glycidyl ether of phenol or a glycidyl ether of a phenol-aldehyde condensate is suitable as such epoxy compound. Among commercial products thereof are Epikote 828, Epikote 1001, Epikote 1002, Epikote 1004, Epikote 1007 and Epikote 1009 (trademarks) produced by Shell Oil Co., Araldite 6071, Araldite 6084, Araldite 6097, Araldite 6099 and Araldite 7072 (trade marks) produced by Ciba Ltd. and Epichlon 800, Epichlon 1000 and Epichlon 1010 (trade marks) produced by Dainippon Ink Co. Polyalkadiene epoxide such as polybutadiene epoxide can also be used. Further, a copolymer of unsaturated compound containing an epoxy group such as glycidyl methacrylate, glycidyl acrylate, N-glycidylacrylamide, allylglycidylether or N-glycidylmethacrylamide with another unsaturated monomer copolymerizable therewith is also useful. As an organic amino compound to be added to such epoxy group, a secondary monoamine is most preferable. However, a primary monoamine or polyvalent amine can also be used together with such secondary monoamine. Examples of these amino compounds are diethylamine, diethanolamine, diisopropylamine, dibutylamine, diamylamine, diisopropanolamine, ethylaminoethanol, ethylaminoisopropanol, n-butylamine, ethanolamine, ethylenediamine and diethylenetriamine.

The aminoacryl resins or aminovinyl resins are basic resins obtained by copolymerizing an acrylate or methacrylate having an amino group or a nitrogen-containing acrylic or vinyl compound such as vinyl pyridine or vinylimidazole with a vinyl compound having no free acid group. Examples of such acrylic acid esters having amino groups are esters of acrylic acids or methacrylic acids and amino alcohols, such as aminoethyl acrylate, aminobutyl acrylate, methylaminoethyl acrylate, dimethylaminoethyl acrylate, hydroxyethylaminoethyl acrylate, aminoethyl methacrylate and dimethylaminoethyl methacrylate. Examples of vinyl compounds having no free acid group and to be copolymerized with the above amino- or nitrogen-containing compounds are acrylic acid and methacrylic acid derivatives such as methyl acrylate, ethyl acrylate, butyl acrylate, 2-ethylhexyl acrylate, acrylamide. N-methylolacrylamide, N-butoxymethylacrylamide, acrylonitrile, methyl methacrylate, ethyl methacrylate, n-butyl methacrylate, isobutyl methacrylate, 2-hydroxyethyl methacrylate, glycidyl methacrylate, and methacrylamide, etc., aromatic vinyl compounds such as styrene, a-methyl styrene, vinyl toluene, etc. and other vinyl compounds such as vinyl acetate, vinyl chloride and vinyl isobutyl ether.

The polyamide resins are condensates of a dibasic acid and a polyvalent amine. Examples of dibasic acids are isophthalic acid, adipic acid and dimer acid, and examples of polyvalent amines are ethylene diamine and diethylene triamine.

As mentioned previously, the basic monomers and resins are at least partially neutralized by a water soluble acid compound.

Examples of acid compounds to be used for the reaction with the basic resin are hydrochloric acid, phosphoric acid, formic acid, acetic acid, propionic acid, citric acid, malic acid, tartaric and acrylic acid, but any other inorganic acids and organic acids may also be used.

A water-dilutable or thinnable organic film-former resin may be obtained by adding to the basic resin 0.2 to 3 equivalents, preferably 0.5 to 1.5 equivalent of the acid compound to the amino groups or basic nitrogen atoms in the basic resin and agitating the mixture at the normal or room temperature.

As a compound which can produce an acid substance by reacting with the amino group or basic nitrogen in the basic resin at the time of the neutralization or modification of the basic resin, there may be mentioned epihalohydrinssuch as epichlorohydrin or epibromohydrin. The amount of this modifier may be 0.5 to 2 equivalents to the amino groups or basic nitrogen atoms in the basic resin. A mixture of the basic resin and modifier are heated to 50° to 100° C. The acid produced in the mixed system at the time of such modification will react with the amino groups in the basic resin to obtain a water dilutable or thinnable cationic binder resin.

The non-ionic synthetic resins in the form of powder and to be used together with the cationic binder resin are those which are solid at the normal or room temperature and can melt when heated in the subsequent baking operation, and may or may not be compatible with the binder resin in the fused film formed at an elevated temperature. The non-ionic synthetic resin should be used in the form of fine powder with an average particle size of 0.5 to 100 microns. Further, the non-ionic resin may be thermosetting by itself or thermoplastic but, preferably, is curable with a curing agent or catalyst which is known per se in the art.

The non-ionic synthetic resins which may be included with the basic resin include those selected from the group consisting of epoxy-resins, polyester resins, acrylic resins, polyurethane resins, polyamide resins, polyolefin resins and cellulose derivative resins.

The epoxy resin is a glycidyl etheride of phenol, a glycidyl etheride of a phenol aldehyde condensate or a phenol glycidyl etheride esterified with 10 to 20% dimer acid. As for the polyester resin there may be used a blend of a melamine resin with a saturated linear polyester or an oil-free alkyd resin.

The acrylic resin is a polymer or copolymer of an acrylate or methacrylate or its copolymer with any other copolymerizable unsaturated monomer. For example, it is a copolymer of an acrylate and styrene, or a copolymer consisting of a methacrylate and unsaturated carboxylic acid. Such acrylic resin may be mixed with a cross-linking agent or curing catalyst such as an amino resin or epoxy resin.

The polyurethane resin is a copolymer produced by the poly-addition of diisocyanate such as trilenediisocyanate or hexamethylenediisocyanate with polyol such as glycol or polyesterglycol, having more than two urethane groups in the molecule.

The polyamide resin is a copolymer produced by the co-condensation of dicarboxylic acid such as aliphatic dicarboxylic acid having more than 6 carbon atoms with diamine such as aliphatic diamine having more than 6 carbon atoms, or by the polycondensation of w-amino acid having more than 6 carbon atoms, or by the ring-opening polymerization of lactam having more than 4 carbon atoms. For examples of said polyamide resin are Tohmide (tradename of Fuji Chemicals Co.) derived from dimer acid and diamine, 6.6-nylon, 6.10-nylon, mixed type nylon Zytel 3606 (trade name of DuPont), alcohol soluble nylon Amilan CM-4000, CM-8000 (trade name of Toray Co.) produced by the co-condensation of caprolactam with 6.10-nylon salt, and N-methoxymethyl substituted nylon Toresin F-30, HF-30 (trade name of Teikoku Chemical Ind.)

The polyolefin resin may be exemplified as polyethylene or polypropylene having a molecular weight of less than 100 thousand and a particle size (as chemically ground of about 1 micron to about 50 microns.

The cellulose derivate resin may be such as cellulose acetate or cellulose acetatebutyrate and may be used supplementally in order to facilitate the flow of the deposited film in the baking step.

The above explained basic resins, cationic binder resins and non-ionic synthetic resins are all when known in the art and mostly commercially available, and therefore no further explanation thereabout will be necessary.

In any case, it will be understood that these resins in the state as used in the deposition bath are in the form of prepolymers or precondensates which are curable by themselves or in the presence of a cross-linking agent or catalyst upon the subsequent heat treatment or baking to form a rigid or tough film.

If desired a mixture of two or more different cationic binder resins, and/or two or more different non-ionic synthetic resins may be employed. In case the cationic binder resin is not compatible with the non-ionic synthetic there is a tendency that there is formed a two-layer film upon the subsequent baking.

While positive employment of a neutralizing solubilizer has been described for both of the above discussed process embodiments, it is within the scope of the invention to employ a film-former that ionizes in water without the addition of a neutralizer.

Coating Bath

The coating bath used in the process of the invention comprises an aqueous suspension of the solubilized carrier of organic film-forming resin. The bath may optionally contain thickeners and suspending agents. Pigments or other particulate material which is applied as the final coating on the substrate or as a part of that coating are also included in the coating bath. As mentioned previously, both reactive and nonreactive pigments or other particulate materials and mixtures thereof may be employed in the process. Of course, the coating may consist entirely of the organic film-forming material and need not include particulate material. In any event, the concentration of the organic film-forming in the bath is preferably maintained in the range of about 0.2 to 40 weight percent.

When pigment or other particulate material is included in the bath, the total amount of nonvolatile solids, i.e., particulate material plus resin, preferably is between about 3 and about 60 weight precent of the bath most preferably between 10 and 50 weight percent. The weight ratio of particulate material to resin nonvolatiles is preferably in the range of 1/9 to 30/1, most preferably ¼ to 20/1.

The concentration of thickeners, when used, is preferably in the range of 1 to 15 grams per kilogram of bath. For example, the preferred concentration of a cellulose thickener is 1 to 3 grams per kilogram of bath and the preferred concentration for a polyvinylpyrrolidone thickener is 9 to 12 grams per kilogram of bath. The bath may also contain a small amount of a curing agent for the organic film-forming material, flow adjusting agent and other additives which are usually used in the art of synthetic resin type paints. Further, the bath may also contain a small amount (i.e., 0–100 parts by weight per 100 parts of the organic film-forming material) of an organic solvent. The organic solvent is useful to increase the adhesiveness of the organic film-forming material, to improve the appearance of the coating film and to improve the stability of the paint.

By way of illustration of the preparation of coating bath, the bath for practicing the first aforementioned embodiment of the process may be prepared by solubilizing a weighed amount of a polycarboxylic acid resin with 1 normal sodium hydroxide to produce a homogeneous dispersion. Pigment and water are then added to produce a viscous product which is mixed for a suitable time to insure proper wetting of the pigment by the resin and the mixture is diluted with water to give the desired bath solids content.

Of course, the weight ratio of particulate material to organic film-forming material will vary widely depending upon the substrate being coated and the type of particulate material being applied. For example, when the particulate material being applied is metal and/or ceramic frit or other refractory material it is preferable to employ a particulate material to organic film-forming material weight ratio in the range of 1/1 to 20/1.

Coating by Coagulation

After the substrate to be coated is provided with a coagulating compound surface as discussed above, it is exposed to the coating bath by such known techniques as immersion, flow coating, etc. for a time period, preferably greater than 5 seconds and less than 20 minutes, to obtain a coating of the desired thickness, e.g., in the range of 0.25 mils (0.00025 inches) to 35 mils (0.035 inches).

As will be apparent to those skilled in the art, the coating bath is preferably agitated as necessary to maintain the dispersion of materials therein during coating.

The completeness and thickness of the coating film which is applied, of course, will vary depending on a number of factors. Perhaps the most important factor is the concentration of coagulating compound sites (e.g. salt sites) per unit area of the substrate. Other factors which will affect the completeness and thickness of the film are bath variables such as the pigment to binder weight ratio as well as the type of organic film-forming material being applied and the type of coagulating compound employed. For example, a polycarboxylic acid resin of 200 acid number was reacted with sodium hydroxide to form a 2% by weight aqueous solution of a salt of the resin. The pigment (Reynolds 400 Aluminum Powder) was added to increase the pigment to binder ratio of the bath. Film thicknesses of the coatings, which were determind at various pigment to organic film-forming ratios are set forth below:

| Pigment/Organic Film-Forming Material | Film Thickness |
|---|---|
| 0/1 | 0.5 mil |
| 0.5/1 | 0.8 mil |
| 1/1 | 1.5 mil |
| 2/1 | 2.5 mil |
| 4/1 | 4.8 mil |
| 8/1 | 4.8 mil |

Post Coating Treatment

As will be apparent from the various examples set forth in this application, various post coating treatments of the coated substrate may be desirable. For example, the coated substrate is desirably heated to remove solvent or water from the coating, particularly if extensive handling of the part is contemplated shortly after coating. Depending on the nature of the organic film-forming material, heating to cure the resin may also be desirable. Also, it may be desirable to heat the substrate to remove the organic film-forming material. If the coating is intended to further modify the substrate surfaces, such as in diffusion coating of metals, further heat treating may be necessary. For example, when the coating applied to a metal substrate includes particulate material comprising metal particles or mixtures of various metal particles and it is desired to diffuse the metal coating into the surface, it is desirable to heat the coated substrate in an ambient essentially inert to the metal particles in said coating to a decomposition temperature above the temperature required to decompose the organic film-forming material in the coating and below the diffusion temperature of the metal, maintain that decomposition temperature until the coating is essentially decomposed and gaseous products thereof are formed, evacuate the gaseous products from the heating zone, maintain the substrate in an ambient essentially inert to the metal particles and raise the temperature to a suitable diffusion temperature for a suitable time to diffuse the coating into the substrate.

Preferred Uses of Process

A first preferred use of the process of the invention is in a process for modifying the surface of a metal substrate of which the major component by weight is selected from cobalt, nickel and iron and constitutes at least 40 weight percent of the substrate. The process comprises:

(a) providing said substrate with a dry coagulating compound, preferably a salt surface;

(b) codepositing by coagulation on said metal substrate a coating of (I) metal particles having an average diameter in the range of 0.5 to 20 microns and selected from (A) aluminum comprising particles wherein the weight ratio of aluminum to other metal is in the range of 200:1 to 1:3 and which are selected from (1) aluminum alloy particles, (2) a mixture of aluminum particles and particles of at least one other metal, (3) a mixture of aluminum particles and particles of at least one alloy, or (B) aluminum particles;

(II) a heat fugitive organic film-forming material, at least 50 weight percent of which is a chemically ionizable organic film-former having at least 12-carbon atoms per molecule in a metal particle to organic film-forming material weight ratio in excess of 3:1, from an aqueous dispersion which forms a coating bath wherein (A) the weight ratio of metal particles in said bath to organic film-forming material in said bath is maintained above 3:1, (B) the concentration of organic filmforming material in said bath is maintained in the range of about 0.2 to about 7 weight percent, and (C) the total weight of non-volatile solids in said bath is maintained below about 35 weight percent of said bath, and (c) heating the substrate and resultant coagulation coating thereon in a heating zone is an ambient essentially inert to the metal particles in said coating to a decomposition temperature above the temperature required to decompose the organic film-forming material in said coating and below the diffusion temperature hereinafter set forth, maintaining said decomposition temperature until said coating is essentially decomposed and gaseous products thereof are formed in said heating zone, essentially evacuating said gaseous products from said heating zone, maintaining the substrate in the heating zone in an ambient essentially inert to the metal particles and raising the temperature of the heating zone to the diffusion temperature and maintaining said diffusion temperature and said ambient for a time sufficient to obtain the desired diffusion.

The metallic substrate upon which the particulate metal is deposited is preferably a substrate which after being processed in accordance with this invention exhibits corrosion resistance at high temperatures. Obviously, various uses of metal parts subjected to high temperatures require varying degrees of high temperature corrosion resistance.

Iron alloys which can be surface modified in accordance with this invention include those which contain very small amounts of alloying components, e.g., carbon steel, as well as those alloys wherein the alloying component or components constitute a substantial percentage of the alloy. The iron alloys contain a minimum of 50 weight percent iron and commonly much more, e.g., about 60 to about 99 weight percent iron. Thus, a broad spectrum of iron base materials are suitable for treatment in accordance with this process including carbon steels, stainless steels and nodular irons. Both cast and wrought alloys of these types can be processed provided heat treatment in a non-oxidizing atmosphere at 1300° F. or above is permissable, i.e., provided that the temperature selected in this range is compatible with recognized metallurgical practices for such alloy.

The nickel and cobalt base materials which may be processed typically contain from about 5 to about 25 weight percent chromium for oxidation resistance, although nickel and cobalt alloys without chromium exist and can be surface modified by this process. Various amounts of refractory elements such as tungsten, tantalum, columbium, molybdenum, zirconium and hafnium are commonly added as solid solution strengtheners and/or carbide formers to improve high temperature strength. Aluminum and/or titanium are added to certain of the nickel base materials to produce age hardening response for additional high temperature strength. In such alloys, the total aluminum plus titanium contents may be as high as 10 weight percent in some.

The nickel alloys contain about 40 weight percent nickel, commonly about 50 to about 80 weight percent. Even when the nickel content of the alloy is between 40 and 50 weight percent, it is the largest single component of the alloy. Correspondingly, the cobalt alloys contain above 40 weight percent cobalt, commonly about 50 to about 80 weight percent. Similarly, when the cobalt content of the alloy is between 40 and 50 weight percent, it is the largest single component of the alloy.

As discussed previously, various factors will affect the thickness of the coating initially applied by coagulation. For a given thickness of coagulated coating, it will be appreciated that the time required for providing a desired depth of diffusion coating will vary depending on the substrate being coated and the coating being applied.

In the preferred use of the process as in others, the areas to be coated are preferably cleaned by conventional processes such as pickling, grit blasting with suitable particulate abrasive, e.g., aluminum oxide particles of about 140–325 mesh, preferably about 220 mesh using a pressure in the range of 40–80 psi, etc. This cleaning is preferably performed not longer than 30 minutes prior to exposure of the part to the coating bath.

Areas not requiring coating may be left uncoated by leaving these portions out of the coating bath during deposition whenever this is feasible. In the alternative, these portions may be masked to prevent coating although exposed to coating bath. Any suitable masking material may be used. For such a process, a suitable masking material is one that will remain in place during the coagulation process, will prevent surface contact of the masked area by the bath during the processing and which will not significantly inerfere with the chemical composition of the bath. Examples of a suitable insulative masking material are rubber, wax, plastic, a removable sleeve of metal, etc.

The particulate metal to be deposited and subsequently diffused into the substrate advisedly has an average particle diameter in the range of about 0.05 to about 20, preferably about 4 to about 9 microns in the case of aluminum. Preferably, the median particle size range is (50 wt. percent is greater than and 50 wt. percent is less than) 6 to 30 microns in the case of aluminum. For even and homogeneous deposits, it is advisable that 0 percent of the particles exceed 74 microns in particle size with not more than 5 percent having particle size above 44 microns. However, small quantities of undesirably large particles may be removed by sieving or by gravitational settling from the coagulation bath.

The particulate metal used in this process is one that when diffused into the surface of the substrate provides a change in surface characteristics that increases the high temperature corrosion resistance of the surface treated. The preferred metallic particles are aluminum particles, aluminum alloy particles, e.g., 60 wt. percent Al—40 wt. percent Pt. 50 wt. percent Al—50 wt. percent Pd. 99 wt. percent Al—1 wt. percent Y, a particulate mixture of aluminum and at least one other metal or metal oxide, e.g., platinum, palladium, chromium $Cr_2O_3$, cobalt, rare earth metals, etc. and a mixture of aluminum particles and the particles of at least one alloy, e.g., 75 wt. percent Al+25 wt. percent (63 wt. percent Co—23 wt. percent Cr—13 wt. percent Al—0.65 wt. percent Y) alloy, 50 wt. percent Al+50 wt. percent (69 wt. percent Al—30 wt. percent Co-1 single wt. percent Y) alloy. While a single coagulation providing a coating containing all of the particulate metal to be deposited is ordinarily preferred, it is within the scope of the invention to carry out successive coagulation steps of different particulate materials.

A typical composition of the aluminum powder or flake used is as follows:

| | Weight Percent |
|---|---|
| Aluminum | 97.0 min. |
| $Al_2O_3$ | 2.0 max. |
| Fe | 0.25 max. |
| Si | 0.15 max. |
| Other metallics, each | 0.03 max. |
| Other metallics, each | 0.15 max. |

The weight ratio of aluminum to other metal or metals in the particulate metal in those embodiments wherein at least one other metal is employed either in separate particulate form or in the form of particulate alloy is in the range of about 200:1 to about 1:3.

Immediately following coating by coagulation, the coated part should be rinsed with water to remove loose adhering bath materials. After removing the masking material, if any, the parts are then oven dired advisedly at a temperature of 160° F. to about 180° F. for about 5 minutes or more to eliminate any residual water from the coating followed by a bake at about 350° F. metal temperature for about 10 minutes to cure the polymer. Of course, where the part will not be handled extensively prior to further processing, the curing step may be omitted.

Following oven drying, the coated parts are heat treated in an ambient inert to the particles deposited. In one embodiment, the heat diffusion step is carried out in a vacuum of about $10^{-4}$ mm. Hg or greater, i.e., a lower pressure, preferably at a pressure not in excess of $5\times10^{-5}$ mm. Hg. In another embodiment, the heat diffusion is carried out in a hydrogen atmosphere having dew point below about −75° F. In firing, the coated article is supported on a support that does not undergo chemical reaction in the firing process, e.g., aluminum oxide.

When the process is carried out in vacuum, the following procedure can be used. The coated part is charged to the heating zone. The vacuum is established and the heating zone is heated to a metal temperature of about 800° to about 1100° F. and held at that temperature until the initial vacuum is restored and the organic portion of the coating has essentially decomposed and the vapors therefrom are removed from the heating zone before heating the part to diffusion temperature. Diffusion is carried out by heating the article to a metal temperature between about 1300° and about 2200° F., commonly between about 1500° F. and about 1900° F. until the desired diffusion of metal from the deposit into the alloy substrate is achieved.

Diffused coating thickness can be determined on parts by microscopic inspection of cross sectional test samples. The average depth will ordinarily be in the range of about 2 to about 5, preferably about 3 to about 4 mils.

By way of further example, a typical heat treat cycle for low carbon steel of a thickness ranging from about 0.035–0.125 inches comprises heating to a metal temperature of 900°–1100° F. for 5 to 15 minutes followed by heating to a metal temperature of 1400°–1600° F. for a period of about 5 to about 15 minutes to produce a diffusion coating with an average thickness of about 3 mils. Of course, depending on such factors as the type of material being coated, the coating material being applied, the temperature at which diffusion is carried out, the thickness of the material and the thickness of the desired diffusion coating, heat treatments of 1 hour or more and even 8 hours or more may be desirable.

A second preferred use of the process of this invention is in a process for coating a substrate with inorganic particulate solids such as ceramic frit or other refractory material. That process comprises:

(A) providing the substrate with a dry coagulating compound, e.g., a salt, surface;

(B) codepositing by coagulation on the substrate a coating having a particulate solids to organic film-forming material weight ratio in excess of 2.5:1 from an aqueous dispersion comprising a vaporizable and chemically ionizable organic film-former which
  (i) has at least 12 carbon atoms per molecule
  (ii) is at least partially ionized such that it is substantially soluble in said aqueous bath, and
  (iii) coagulates and deposits in the presence of said coagulating compound and inorganic particulate solids selected from ceramic frit and metal and having an average major dimension between about 2 and about 70 microns.

In accordance with this process, the following limitations on bath parameters are desirable:

(1) The concentration of organic film-forming material in the bath is preferably within the range of about 0.02 to about 2, preferably about 0.5 to about 2, parts by weight of organic film-forming material to 100 parts by weight of coating bath.

(2) The weight to weight ratio of particulate material in said bath to organic filmforming material in the bath is preferably within the range of about 2.5 to about 35 to 1, preferably about 3.5 to about 20 to 1.

(3) The concentration of depositables in the bath is preferably within the range of about 1.7 to about 30, preferably about 5 to about 25, parts by weight total depositables per 100 parts by weight of bath.

When the particulate material is ceramic frit, the organic film-forming materials must be materials that will vaporize during the firing cycle through which the particulate frit is converted to a continuous film. This vaporization generally should take place at temperatures below about 1500° F., preferably between about 900 and about 1100° F., most preferably below about 1000° F.

The invention will be more fully understood after reading the specific examples which follow. However, it should be understood that the examples are merely intended to be illustrative of certain embodiments of the invention and are not to be considered limiting.

EXAMPLE 1

Coagulation deposition of a paint is carried out with the materials and method hereinafter set forth:

Preparation of Coating Bath

A linseed oil coupled with maleic anhydride, diluted with water and solubilized with diisopropanol amine was prepared as follows:

(A) 6,197 parts—Linseed oil and (B) 1,484 parts—maleic anhydride were reacted in an agitation tank for 3 hours at 232° C. and then cooked at 157° C.

(C) 1,309 parts—Vinyl toluene containing 35 parts tertiary butyl peroxide was added to (B) and the mixture reacted at 218° C. for 1 hour. The mixture was cooled to 157° C.

(D) 3,875 parts—Oil soluble phenolic resin was added to (C) and the mixture reacted for 1 hour at 176° C. The mixture was cooled to 93° C. and (E) 3,000 parts—Deionized water was added (F) 2,060 parts—Diisopropanol amine a was added to (E) at 75°–90° C. to neutralize the resin.

(G) 17,179 parts—Deionized water was added to further reduce the vehicle. Based on the resin solids of the vehicle 2% by weight carbon black and 8% by weight corrosion inhibiting pigments were added. The resultant bath had a pH of 8.5.

Coagulation Process

The bath prepared as above is placed in a metal or plastic container and agitated to provide uniform suspension of the paint pigments. The bath temperature is maintained at about 40° to 125° F., most preferably between 65° to 75° F.

An article of 1010 steel is alkali cleaned in a 2 oz./gal. solution of Stauffer 128 NP cleaner for 5 minutes at 160° F. to 170° F., removed, tap water rinsed, hot air dried and permitted to cool to room temperature. The article is immersed in a 10% by weight nickel chloride hexahydrate in methanol solution, withdrawn at a rate of 12 inches per minute and heated in a convection oven for 5 minutes at 160° F., removed and permitted to cool to room temperature. The article is then immersed in the coating bath for one minute, removed and tap water rinsed and the resultant film cured at 360° F. for 25 minutes which resulted in a smooth, glossy, adherent 0.6 mil coating. Additional articles were coated and salt spray tested according to ASTM Test Method No. B117-64. The coating exhibited excellent corrosion protection after 240 hours exposure. In addition good adhesion, cross hatch and other good physical properties were obtained.

EXAMPLE 2

A coagulation coating bath consisting of an aminoepoxy resin was prepared as follows:

(A) 488 parts—Epikote 1001, and (B) 105 parts—Diethanolamine and (C) 250 parts—Isopropyl alcohol were reacted under reflux for 3 hours at 80° C. to give an aminoepoxy resin.

(D) 100 parts—Epoxy resin powder (Epikote 1004), and (E) 3 parts—Butvar D 510 leveling agent, a product of Monsanto Co. and (F) 40 parts—Rutile type titanium oxide and (G) 5 parts—Dicyandiamide were melted and kneaded together to produce a solidified mixture which was pulverized into a powder having a maximum particle diameter of 100 microns and an average particle diameter of 40 microns.

(H) 6.2 parts—Glacial acetic acid and (I) 500 parts—Deionized water are added to (J) 143 parts—of the resin of (C) and the mixture agitated in a dissolver.

(K) 634 parts—Powder (G) is added to the resulting mixture from (J), dispersed in a homogenizer for 30 minutes and then diluted with deionized water to give a coating bath of 12% solids. Glacial acetic acid is then added to adjust the pH to 4.4–4.5.

The coating both from (K) is placed into a plastic container and agitated to maintain uniform suspension of the pigment.

An article of 1010 steel is alkali cleaned and rinsed and dried as in Example 1. The article is then immersed in a 2.6% by weight sodium hydroxide in methanol solution, withdrawn at a rate of 12 inches per minute and heated and cooled as in Example 1. The article is then immersed in the coating bath for 1 minute, withdrawn, rinsed and baked for 25 minutes at 360° F. which resulted in a 0.7 mil coating.

EXAMPLE 3

A coating bath consisting of 20% bath solids, in which 89.9% by weight of the solids is metallic aluminum powder and 11.1% by weight of a polycarboxylated heat fugitive arcylic acid resin is prepared as follows:

(A) 111 grams—Acrylic acid resin[1] in butyl cellosolve which contains 77.8 grams of resin solids is reacted with 2.5 grams of sodium hydroxide (62.2 milliliters 1 normal sodium hydroxide). This resin is prepared from the following materials in the following manner:

(a) To a reaction vessel is charged 900 parts by weight Cellosolve and the same is heated to 140° C.

(b) While maintaining this temperature, there is added dropwise over a 3.5 hour period a mixture of

| | Parts by weight |
|---|---|
| Methacrylic acid | 226 |
| 2-ethyl hexyl acrylate | 630 |
| Styrene | 1034 |
| Hydroxy ethyl methacrylate | 210 |
| Azobisisobutyronitrile | 21 |

(c) After addition is complete, the temperature of 140° C. is held for 0.5 hour and the resin recovered. The resin as an acid value of about 71 and an X-Y Gardener-Holdt viscosity at 50% solids in butyl Cellosolve.

(B) 624 grams—Reynolds 400 atomized aluminum powder (406 micron APD) and (C) 435 grams—Deionized water are added to (A) and the mixture is blended for 2 hours under high shear agitation to give (D) 1170 grams—60% (by weight) bath.

(E) 2330 grams—Deionized water is slowly added to (D) to give (F) 3500 grams—Coating bath.

The above bath from (F) is placed under agitation to insure uniform suspension of the metal powder.

An article of 1010 steel or Tinamel (Titanimum strengthened low carbon steel) is processed the same way as in Example 1 using a 10% (by weight) nickel chloride hexahydrate in ethanol solution for application of coagulant by immersion. The part is immersed in the coating bath for 1 minute, withdrawn, rinsed with tap water and the aluminum coated article is baked for ½ hour at 180° F. The article with its smooth, adherent 4.0–5.0 mil coating is placed into a furnace whose atmosphere is essentially inert to the metal particles. The coated article is heat treated at a metal temperature of 900° F. for 5 minutes to vaporize the heat fugitive resin and is then heat treated at a metal temperature of 1500° F. for 5–10 minutes. The result is a highly oxidation and corrosion resistant coating essentially of iron aluminide.

EXAMPLE 4

A coating bath consisting of 48% by weight bath solids, of which 4.8% by weight is a heat fugitive polycarboxyl acrylic acid resin and 95.2% by weight is a ceramic enamel frit is prepared as follows:

(A) 447 grams—Sodium hydroxide presolubilized acrylic acid resin prepared in Example 3 which contains 174 grams of resin solids is mixed under agitation with (B) 4941 grams—Ceramic mill slip of Ferro Frit #234 which contains 3459 grams pigment solids, 4% of which is retained in a USA Standard Sieve No. 400 until a homogeneous blend results to give (C) 5388 grams—Viscous slurry containing 64.4% solids by weight.

(D) 1136 grams—Hydroxy propyl methyl cellulose aqueous dispersion containing 11.4 grams of the thickener is blended into (C) to give (E) 6524 grams—Bath which is diluted with (F) 1046 grams—Deionized water to give (G) 7570 grams—Coating Bath at 48% solids by weight.

Bath (G) is placed into a stainless container and agitated to maintain uniform suspension of the pigment.

An article of Tinamel is aluminum oxide blasted (200 Mesh) at 100 psi. The article is immersed into a 20% by weight nickel chloride hexahydrate in ethanol solution, removed at a controlled rate as in Example 1 and the coagulant dried at 160° F. for 5 minutes and cooled to room temperature for 5 minutes. The pretreated article is immersed into bath (G) for 1 minute, withdrawn and the coated article tap water rinsed, dried at 360° F. for 30 minutes. An 8–10 mil coating is formed on the article which is then fired at 160° F. for 6 minutes which results in a 3.0–5.0 mil oxidation and corrosion resistant glass coating.

EXAMPLE 5

A paint comprising approximately 15% by weight of the bath solids in which approximately 80% by weight of the solids consists of an amine solubilized polybutadiene resin and approximately 20% by weight pigment was prepared as follows:

(A) 1514 grams—Polybutadiene paint[2] containing approximately 908 grams resins solids and 227 grams pigment is solubilized with 38.8 grams of diethylamine under high shear stirring.

[2] A water dispersable paint PPG-1260, comprising 1.4 polybutadiene, developed by PPG Industries.

(B) 6056 grams—Deionized water is slowly worked into (A) to give (C) 7570 grams—Coating bath at 15% solids.

The bath (C) was placed into a container and agitated as in Example 1. An article of low carbon steel is processed in the same manner as in Example 1 except the coagulant solution is a 5% by weight cupric chloride dihydrate in ethanol. The coated article is tap water rinsed and cured at 360° F. for 25 minutes which resulted in a smooth, adherent 0.4 mil coating.

EXAMPLE 6

The coating bath of Example 1 is used to apply a 0.6–0.7 mil opaque decorative coating on a glass article. The article is etched by mild blasting using finely divided powdered glass beads, and is immersed into a 10% by weight aqueous solution of aluminum chloride and the coagulant dried at 160° F. for 5 minutes and allowed to cool at room temperature for 5 minutes. The glass article is immersed for 1 minute into bath (G) of Example 1. The article is withdrawn and the film is baked at 360° F. for 30 minutes which gives a 0.6–0.7 mil adherent, decorative coating.

EXAMPLE 7

The same procedure for application of the coagulant of Example 6 is used to coat a plastic article, and a decorative paint film is applied by immersing the article in bath (G) of Example 1.

EXAMPLE 8

The same procedure in Example 6 is used to apply the coagulant of Example 3 onto a glass article except an aluminum coating is applied by immersing the article into bath (F) of Example 3.

EXAMPLE 9

The coating bath is the same as in Example 3 except the metal article to be coated is a nickel base alloy (58% Ni, 9% Cr, 10% Co, 10% W, 6% Al, 2% Mo, 4% Ta, 1% Ti) containing approximately 59 weight percent nickel. The coagulant is a 10% by weight solution of cobaltous chloride hexahydrate in n-propanol. The article prior to application of cobaltous chloride was aluminum oxide grit blasted at 80 psi. Immersion time in bath (F) of Example 3 is 1 minute. The coated particle was tap water rinsed, and dried at 180° F. for ½ hour. The coated article is heat treated in vacuum for 4 hours at a metal temperature of 1900° F. The surface modification or coating of nickel aluminide is capable of providing oxidation protection for the article at high temperatures.

EXAMPLE 10

A process for the application of a water impermeable coating on porous articles such as wood (laminated or unlaminated) is accomplished by immersing said article into the coagulant of Example 1, withdrawing the article and drying the coagulant at 160° F. for 5 minutes. After the article is cool, it is immersed into bath (G) of Example 1 for 2 minutes, withdrawn, tap water rinsed, and baked at 180° F. for ½ hour.

EXAMPLE 11

The coating bath (F) of Example 3 is used to apply a coating of aluminum on a glass article. The article is lightly blasted with 200 mesh aluminum oxide, and immersed into a 10% by weight aqueous solution of hydrofluoric acid, withdrawn and the applied salt dried. After immersing the article in the coagulation coating bath for 1 minute, it is withdrawn, rinsed and baked for 30 minutes at 360° F. An adherent 2.5 mil coating resulted.

EXAMPLE 12

The coating bath (G) of Example 1 was used to apply protective coating to a steel metal article. The article was cleaned as in Example 1 and immersed into a 10% by weight nickel chloride, 3.5% by weight hydrochloric acid in methanol solution. The article was coated in bath (G), Example 1, rinsed and baked at 360° F. An adherent, smooth 1.0 mil coating resulted.

EXAMPLE 13

The coating bath (G) of Example 1 was used to apply a protective coating on a steel article. The article was cleaned as in Example 1, except the article was immersed into a 5% by weight hydrochloric acid in ethanol solution. After the article was withdrawn, and dried, it was immersed for 1 minute into the coating bath. The article was withdrawn, rinsed and baked at 360° F. which resulted in an adherent, smooth 0.5 mil coating.

EXAMPLE 14

The same procedure for coating a glass article was used to apply an aluminum powder coating as in Example 11, except the coagulant was an aqueous 10% by weight hydrofluoric acid, 5% by weight cobaltous nitrate solution. The coating which resulted was 9.0 mils.

EXAMPLE 15

An acrylic polymer as prepared in Example 3 was solubilized by reacting the total acid number with an equivalent amount of sodium hydroxide. A steel article is cleaned by the procedure in Example 1 and immersed into a 10% by weight nickel chloride in ethanol solution, withdrawn and dried. The article was immersed into the resin coating bath for 1 minute, withdrawn, and the coated article baked for 25 minutes at 360° F. A glossy, adherent, smooth 0.8 mil coating resulted.

EXAMPLE 16

The coating bath in Example 5 is used to apply a paint film on a 1010 steel article, previously zinc phosphate coated by Parker Chemical Company's Bonderite 411/P-85 phosphating process. The article is immersed into a 15% by weight nickel chloride in ethanol solution and withdrawn at a controlled rate, dried and cooled as in Example 1. After immersion of the article into bath (C) of Example 5 for 1 minute, it is withdrawn, tap water rinsed and the resultant film cured. The coating which resulted was 0.7–0.8 mil thick, smooth, adherent and provided excellent salt corrosion protection when tested as in Example 1.

EXAMPLE 17

The coating bath in Example 5 was used to apply a paint film on 1010 steel article except the article was grit blasted with 200 mesh aluminum oxide powder prior to immersion into the salt solution of Example 5. In this case the paint film was applied by flowing the bath at a controlled rate over the surface of the article for a period of 1 minute. The resultant film after rinsing and curing was continuous, adherent and 0.7 to 0.75 mils. thick.

EXAMPLE 18

A coating was applied on a steel article using the coating bath (C) in Example 5 except the coagulating salt was applied by blasting the surface of the article with a mixture composed of 2.5% by weight nickel chloride in a 200 mesh aluminum oxide powder at a pressure of 60–80 psi. The powder mixture was uniformly blended prior to blasting using a high speed blender. The article was dried at 160° F. and cooled to room temperature. Immersing the part into the coating both for 1 minute followed by a tap water rinse and curing of the film resulted in a continuous 0.5 mil coating.

It will be understood by those skilled in the art that modifications can be made in the foregoing examples and within the scope of the invention as hereinbefore described and hereafter claimed.

We claim:

1. A process for coating a substrate comprising:

(A) providing said substrate with a surface coating of a dry coagulating compound; and (B) exposing said coated substrate to an aqueous composition which, except for solvents, reactive and nonreactive pigments and other nonreactive particulate material, consists essentially of an organic film-forming material consisting essentially of (i) at least fifty (50) weight percent of a chemically ionizable, organic film-former which (a) has at least 12 carbon atoms per molecule, (b) is at least partially ionized such that it is substantially soluble in said aqueous composition, and (c) coagulates in the presence of said coagulating compound; and (ii) a remainder of an organic film-former which is not chemically ionizable.

2. A process in accordance with claim 1, wherein said coagulating compound is selected from the group consisting of (i) bases having a pH greater than 10, (ii) basic salts, and (iii) mixtures of (i) and (ii), and said organic film-former is selected from basic monomers and resins having one or more nitrogens in their molecular structure and is at least partially neutralized by a water soluble acid compound.

3. A process in accordance with claim 2 wherein said basic salts are selected from the group consisting of carbonates, silicates, oxalates, salicylates and formates of alkali earth metals.

4. A process in accordance with claim 2 wherein said bases are alkali earth metal hydroxides.

5. A process in accordance with claim 1, wherein the concentration of organic film-forming material in said aqueous composition is maintained in the range of about 0.2 to about 40 weight percent and said composition includes particulate material which is (i) codeposited with said organic film-forming material and (ii) present in said composition in an amount such that the weight ratio of particulate material to organic film-forming material in said composition is in the range of 1:9 to 30:1.

6. A process in accordance with claim 5 wherein said substrate and said particulate material are both metal, said particulate material being present in said bath such that the weight ratio of metal particles to organic film-forming material is in the range of 1:1 to 20:1.

7. A process in accordance with claim 6 wherein said substrate is heated, after said organic film-forming material and metal particles are codeposited thereon, in an ambient essentially inert to the metal particles and said coating to a decomposition temperature above the temperature required to decompose the organic film-forming material in said coating and below the diffusion temperature for said particles, maintaining said decomposition temperature until said coating is essentially decomposed and gaseous products thereof are formed in the heating zone, essentially evacuating said gaseous products from said heating zone, maintaining said substrate in said heating zone in an ambient essentially inert to the metal particles and raising the temperature of said heating zone to the diffusion temperature of the metal, and maintaining said diffusion temperature and said ambient for a time necessary to effect the desired diffusion coating.

8. A process in accordance with claim 5 wherein said particulate material is selected from the group consisting of ceramic frit, metal particles and mixtures thereof and is present in such an amount that the particulate material to organic film-forming material weight ratio is in the range of 1:1 to 20:1.

9. A process in accordance with claim 8 wherein said substrate is heated after said organic film-forming material and said particulate material are codeposited, to a temperature sufficient to vaporize said organic film-forming material.

10. A process in accordance with claim 9 wherein said particulate material is ceramic frit and said substrate is heated after vaporization of said organic film-forming material to a temperature for a time sufficient to unitize said ceramic frit on the surface of said substrate.

11. A process in accordance with claim 1, wherein said coagulating compound is a metal salt having a pH of less than 7.0 and said organic film-former is a polycarboxylic acid resin which is at least partially neutralized with a water soluble base.

12. A process in accordance with claim 11, wherein said polycarboxylic acid resin is synthetic and has (i) an electrical equivalent weight between about 1,000 and about 20,000, and (ii) an acid number between about 30 and about 300.

13. A process in accordance with claim 11, wherein said metal salt is a salt of a First Transition Series metal.

14. A process in accordance with claim 11, wherein said salt has a pH of between about 3.5 and about 4.5 and is selected from the group consisting of nickel chloride, cupric chloride, cobaltous chloride, cupric nitrate, nickel nitrate, cupric sulfate, zinc chloride and mixtures thereof.

15. A process in accordance with claim 11, wherein said substrate is a metal and said salt is formed at least in part by treating said substrate with an acid.

16. A process in accordance with claim 11, wherein said metal salt is nickel chloride, said organic film-former is included in said aqueous composition in a concentration of between about 0.2 and about 40 weight percent, and said chemically ionizable organic film-former consists essentially of a synthetic polycarboxylic acid resin which (i) has an electrical equivalent weight between about 1,000 and about 20,000, (ii) has an acid number between about 30 and about 300, (iii) is prepared by coupling a linseed oil with maleic anhydride, and (iv) is at least partially neutralized with a water soluble amine.

17. A process in accordance with claim 16, wherein said aqueous composition includes particulate material which is (i) codeposited with said organic film-forming material and (ii) present in said composition in an amount such that the weight ratio of particulate material to organic film-forming material in said composition is in the range of 1:9 to 30:1.

18. A process in accordance with claim 17, wherein said particulate material is selected from the group consisting of ceramic frit, metal particles and mixtures thereof and is present in such an amount that the particulate material to organic film-forming material weight ratio is in the range of 1:1 to 20:1.

19. A process in accordance with claim 18, wherein said substrate is heated after said organic film-forming material and said particulate material are codeposited, to a temperature sufficient to vaporize said organic film-forming material.

20. A process in accordance with claim 19, wherein said particulate material in ceramic frit and said substrate is heated after vaporization of said organic film-forming material to a temperature for a time sufficient to unitize said ceramic frit on the surface of said substrate.

21. A process in accordance with claim 17, wherein said substrate and said particulate material are both metal, said particulate material being present in said aqueous composition such that the weight ratio of metal particles to organic film-forming material is in the range of 1:1 to 20:1.

22. A process in accordance with claim 21, wherein said substrate is heated, after said organic film-forming material and metal particles are codeposited thereon, in an ambient essentially inert to the metal particles and said coating to a decomposition temperature above the temperature required to decompose the organic film-forming material in said coating and below the diffusion temperature for said particles, maintaining said decomposition temperature until said coating is essentially decomposed and gaseous products thereof are formed in the heating zone, essentially evacuating said gaseous products from said heating zone, maintaining said substrate in said heating zone in an ambient essentially inert to the metal particles and raising the temperature of said heating zone to the diffusion temperature of the metal, and maintaining said diffusion temperature and said ambient for a time necessary to effect the desired diffusion coating.

23. A process for coating a substrate comprising:

(A) providing said substrate with a surface coating of a dry coagulating compound; and (B) immersing said coated substrate in an aqueous bath which, except for solvent, consists essentially of:

(1) between about 0.2 and about 40 weight percent based on the total weight of the bath of an organic film-forming material consisting essentially of (a) at least about fifty (50) weight percent of a chemically ionizable, organic film-former which (i) has at least 12 carbon atoms per molecule, (ii) is at least partially ionized such that it is substantially soluble in said aqueous bath, and (iii) coagulates and deposits on said substrate in the presence of said coagulating compound, and (b) a remainder of an organic film-former which is not chemically ionizable; and (2) particulate material which is (a) codeposited with said organic film-forming material, and (b) present in said aqueous bath in an amount such that the weight ratio of particulate material to organic film-forming material in said bath is in the range of 1:9 to 30:1.

24. A process in accordance with claim 23, wherein said coagulating compound is a metal salt having a pH of less than 7.0 and said organic film-former is a polycarboxylic resin which is at least partially neutralized with a water soluble base.

25. A process in accordance with claim 24, wherein said polycarboxylic acid resin is synthetic and has (i) an electrical equivalent weight between about 1,000 and about 20,000, and (ii) an acid number between about 30 and about 300.

26. A process in accordance with claim 24 wherein said salt is selected from the group consisting of nickel chloride, cupric chloride, cobaltous chloride, cupric nitrate, nickel nitrate, cupric sulfate, zinc chloride and mixtures thereof.

27. A process in accordance with claim 23, wherein said coagulating compound is selected from the group consisting of (i) bases having a pH greater than 10, (ii) basic salts, and (iii) mixtures of (i) and (ii), and said organic film-former is selected from basic monomers and resins having one or more nitrogens in their molecular structure and is at least partially neutralized by a water soluble acid compound.

28. A process for modifying the surface of a metal substrate of which the major component by weight is selected from cobalt, nickel and iron and constitutes at least 40 weight percent of said substrate, said process comprising (a) providing said substrate with a surface coating of a dry coagulating compound, (b) codepositing by coagulation on said metal substrate a coating of (I) metal particles having an average diameter in the range of 0.5 to 20 microns and selected from (A) aluminum comprising particles wherein the weight ratio of aluminum to other metal is in the range of 200:1 to 1:3 and which are selected from (1) aluminum alloy particles, (2) a mixture of aluminum particles and particles of at least one other metal, (3) a mixture of aluminum particles and particles of at least one metal oxide, and (4) a mixture of aluminum particles and particles of at least one alloy, or (B) aluminum particles; and (II) a heat fugitive organic film-forming material consisting essentially of at least 50 weight percent of a chemically ionizable, organic film-former having at least 12 carbon atoms per molecule and a remainder of organic film-former which is not chemically ionizable, in a metal particle to organic film-forming material weight ratio in excess of 3:1, from an aqueous dispersion forming a coating bath which, except for solvent, consists essentially of said metal particles and said organic film-forming material, said chemically ionizable organic film-former being at least partically ionized and adapted to coagulate and deposit in the presence of said coagulating compound, and wherein (A) the weight ratio of metal particles in said bath to organic film-forming material in said bath is maintained above 3:1, (B) the concentration of organic film-forming material in said bath is maintained in the range of about 0.2 to about 7 weight percent based on the total weight of the bath, and (C) the total weight of non-volatile solids in said bath is maintained below about 35 weight percent of said bath, and (C) heating said substrate and resultant codeposition coating thereon in a heating zone in an ambient essentially inert to said metal particles and said coating to a decomposition temperature above the temperature required to decompose the organic film-forming material in said coating and below the diffusion temperature of said metal particles, maintaining said decomposition temperature until said organic film forming material is essentially decomposed and gaseous products thereof are formed in said heating zone, essentially evacuating said gaseous products from said heating zone, maintaining said substrate in said heating zone in an ambient essentially inert to the metal particles and raising the temperature of said heating zone to a diffusion temperature of at least 50° above melting point of aluminum and below about 2200° F., and maintaining said diffusion temperature and said ambient for a time in excess of about 1 hour.

29. A process in accordance with claim 28, wherein said coagulating compound is a metal salt having a pH of less than 7.0 and said organic film-former is a synthetic polycarboxylic resin which is at least partially neutralized with a water soluble base.

30. A process in accordance with claim 29, wherein said metal salt is formed at least in part by treating said substrate with an acid.

31. A process in accordance with claim 29 wherein said polycarboxylic acid resin has (i) an electrical equivalent weight between about 1,000 and about 20,000, and (ii) an acid number between about 30 and about 300.

32. A process in accordance with claim 29 wherein said salt is selected from the group consisting of nickel chloride, cupric chloride, cobaltous chloride, cupric nitrate, nickel nitrate, cupric sulfate, zinc chloride and mixtures thereof.

33. A process in accordance with claim 28 wherein said coating has an average depth of about 3 and about 7 mils and said diffusion temperature is in the range of about 1300° F. to bout 2100° F.

34. A process in accordance with claim 28 wherein said weight ratio of metal particles in said bath to organic film-forming material in said bath is maintained in the range of 5:1 to 20:1.

35. A process in accordance with claim 28 wherein said concentration of organic film-forming material in said bath is maintained in the range of about 0.2 to about 2 weight percent.

36. A process in accordance with claim 28, wherein said coagulating compound is selected from the group consisting of (i) bases having a pH greater than 10.0, (ii) basic salts and (iii) mixtures thereof, and said organic film-former is selected from basic monomers and resins having one or more nitrogens in their molecular structure and is at least partially neutralized by a water soluble acid compound.

* * * * *